US006941723B2

(12) United States Patent
Di Stasio

(10) Patent No.: US 6,941,723 B2
(45) Date of Patent: Sep. 13, 2005

(54) DEVICE FOR FILLING BOXES WITH A NUMBER OF ROWS OF OBJECTS

(76) Inventor: Modesto Di Stasio, Via C.S. Italico, 28, Venafro (IS) (IT), I-86079

( * ) Notice: Subject to any disclaimer, the term of this patent is extended or adjusted under 35 U.S.C. 154(b) by 0 days.

(21) Appl. No.: 10/640,324

(22) Filed: Aug. 14, 2003

(65) Prior Publication Data

US 2005/0034424 A1 Feb. 17, 2005

(51) Int. Cl.[7] ..... B65B 5/08
(52) U.S. Cl. ..... 53/247; 53/253
(58) Field of Search ..... 53/473, 475, 247, 53/235, 250

(56) References Cited

U.S. PATENT DOCUMENTS

| | | | | | |
|---|---|---|---|---|---|
| 2,807,125 | A | * | 9/1957 | George | 53/539 |
| 3,185,328 | A | * | 5/1965 | Dardaine et al. | 414/416.06 |
| 3,780,492 | A | * | 12/1973 | Corderoy | 53/247 |
| 3,971,190 | A | * | 7/1976 | McGill | 53/77 |
| 4,546,594 | A | * | 10/1985 | Mohaupt | 53/447 |
| 4,793,762 | A | * | 12/1988 | Munch et al. | 414/416.06 |
| 4,835,939 | A | * | 6/1989 | Thomas et al. | 53/248 |
| 4,977,727 | A | * | 12/1990 | Milleson | 53/543 |
| 5,133,169 | A | * | 7/1992 | Tesch et al. | 53/247 |
| 5,456,563 | A | * | 10/1995 | Halbo | 414/416.06 |
| 5,487,257 | A | * | 1/1996 | Domeier et al. | 53/539 |
| 5,611,193 | A | | 3/1997 | Farrelly | |
| 6,722,101 | B2 | * | 4/2004 | Hartness et al. | 53/247 |

FOREIGN PATENT DOCUMENTS

| | | |
|---|---|---|
| DE | 11 52 352 | 8/1963 |
| DE | 39 27 848 | 2/1991 |
| FR | 1 383 929 | 1/1965 |

* cited by examiner

*Primary Examiner*—Rinaldi I. Rada
*Assistant Examiner*—Paul Durand
(74) *Attorney, Agent, or Firm*—Young & Thompson

(57) ABSTRACT

A cartoning machine to arrange a predetermined number of objects fed on one or more rows by a belt conveyer in boxlike containers, able to operate in unison with production machines running at very high speed and having a simple, reliable construction comprising several heads (55) to grip the objects which are arranged on at least one working station and are put into rotation to take the objects from the feeding rows and to lay them down into cartons carried on a second belt conveyer placed at 180 DEG from the first conveyer.

15 Claims, 8 Drawing Sheets

DEVICE FOR FILLING BOXES WITH A NUMBER OF ROWS OF OBJECTS

BACKGROUND OF THE INVENTION

The present invention relates to a cartoning machine to enclose in boxlike containers a predetermined number of objects arranged on one or more rows. In particular the machine described and illustrated herein is of the type capable of enclosing containers of liquids such as bottles in cartons to be shipped and stored. Such machine, so-called rotatable cartoning machine by those skilled in the art, should operate in unison with filling and capping machines running at very high speed. Therefore, it is necessary that also the rotatable cartoning machine operates at the very high speed compatible with the feeding rate of the containers to be enclosed in cartons in order to avoid an undesirable slowing down in filling the cartons to be shipped.

The present invention seeks to provide a cartoning machine or, as mentioned above, a rotatable cartoning machine having a simple construction and a low cost and being able to meet the packing quickness required by industry today.

As well known to those skilled in the art, the packing of a variety of even different items with different size to be shipped and stored is performed in cardboard boxes. Therefore, such boxes have extremely varying size and capacity even for the same kind of products. As far as the present Patent Application is concerned that relates only by way of illustration to the packing of liquid containers such as bottles in cardboard boxes, it should be appreciated that a great variety of containers such as bottles for drinks, mineral water, fruit juice and the like as well as containers with or without handle containing detergents, cleansing agents and the like can be taken into consideration. It follows that a rotatable cartoning machine capable of operating only with such containers should be extraordinarily flexible to be adapted to the great variety of containers, bottles and the like used in the industry today and having, for example, a great variety of heights, shapes, size etc. above all with regard to containers for detergents, cleansing agents and the like which very often are provided with handle and/or dispensing devices causing their width to change in addition to the change in height due to the different capacities of the containers imposed by commercial requirements.

SUMMARY OF THE INVENTION

Therefore, the present invention seeks to provide a rotatable cartoning machine with a simple, cheap structure capable of operating at high speed according to very different cartoning requirements, with the containers to be packed being fed to a belt on either one row or more rows.

The machine according to the invention will be here described to operate with containers fed on only one row, however, as mentioned in greater detail thereafter, it will be able to operate with containers fed on more rows by simple modifications of the gripping means.

The essential novel feature of the machine according to the invention is its flexibility as the cartoning heads can operate with packing cartons receiving the bottles on one or more rows, such heads being of the type for one row, multiple rows, or also for the content of the whole packing cartons in case of compatibility with the feeding rate of the upstream machine.

The present Patent Application discloses a rotatable cartoning machine operating on line with a filling machine for liquid containers and provided with cartoning heads which take bottles on one row and lay down them into cartons with a capacity of six to twenty bottles.

The machine consists of a parallelepiped body with square base carrying a rotating driven central shaft in a vertical position to which an assembly of at least one cartoning head, each provided with a plurality of grippers, is connected by a square body, each cartoning head being placed on one side of such square body parallel to another side of the square body carrying the other cartoning head.

Each cartoning head has a plurality of mechanically operated grippers arranged on one or more rows, as better seen thereafter, each of them being carried at the same level of the rows of containers fed by the upstream production machine and being able to catch and lift a bottle. The head is then lifted, shifted or rotated, or both shifted and rotated, so as to be located above the carton receiving the containers that are then laid down by the opening of the grippers.

The actions of lifting, shifting, rotating are provided by controlled mechanical means.

In a first embodiment such means consists of pneumatic cylinder and piston assemblies.

In a second preferred embodiment such means consists of a cam and idle pulley assembly. Such cam has a generally circular shape in horizontal projection and is driven and shaped so as to perform in parallel both bottle taking and laying down operations, thus allowing a perfect balancing of the load.

Both such embodiments will be described in greater detail thereafter.

Another important feature of the machine of the present application is the capability of the grippers belonging to the several heads to rotate about their own axis to enclose generally objects, particularly containers, having a non-circular or elongated section into the cartons. The rotation of the grippers is performed by controlled mechanical means.

In a first embodiment such means consists of pneumatic cylinder and piston assemblies.

In a second preferred embodiment such means consists of mechanical devices.

Both such embodiments will be described in greater detail thereafter.

Another important feature of the machine according to the invention consists of the construction and shape of the belt conveyer on which the bottle packing cartons rest. Such belt conveyer is suitably inclined to cause the bottles to settle on rows against the walls of the carton, thus avoiding any turnover when the same are released by grippers. Suitable mechanical means driven for example by a pneumatic cylinder and piston assembly allows the cartons to be shifted on the belt and new rows of bottles to be enclosed sequentially in the cartons.

Still a further feature of the cartoning machine is the interchangeability of the grippers.

BRIEF DESCRIPTION OF THE DRAWINGS

The invention will now be described in greater detail in the accompanying drawings, wherein.

DESCRIPTION OF THE PREFERRED EMBODIMENT

Figure 1:
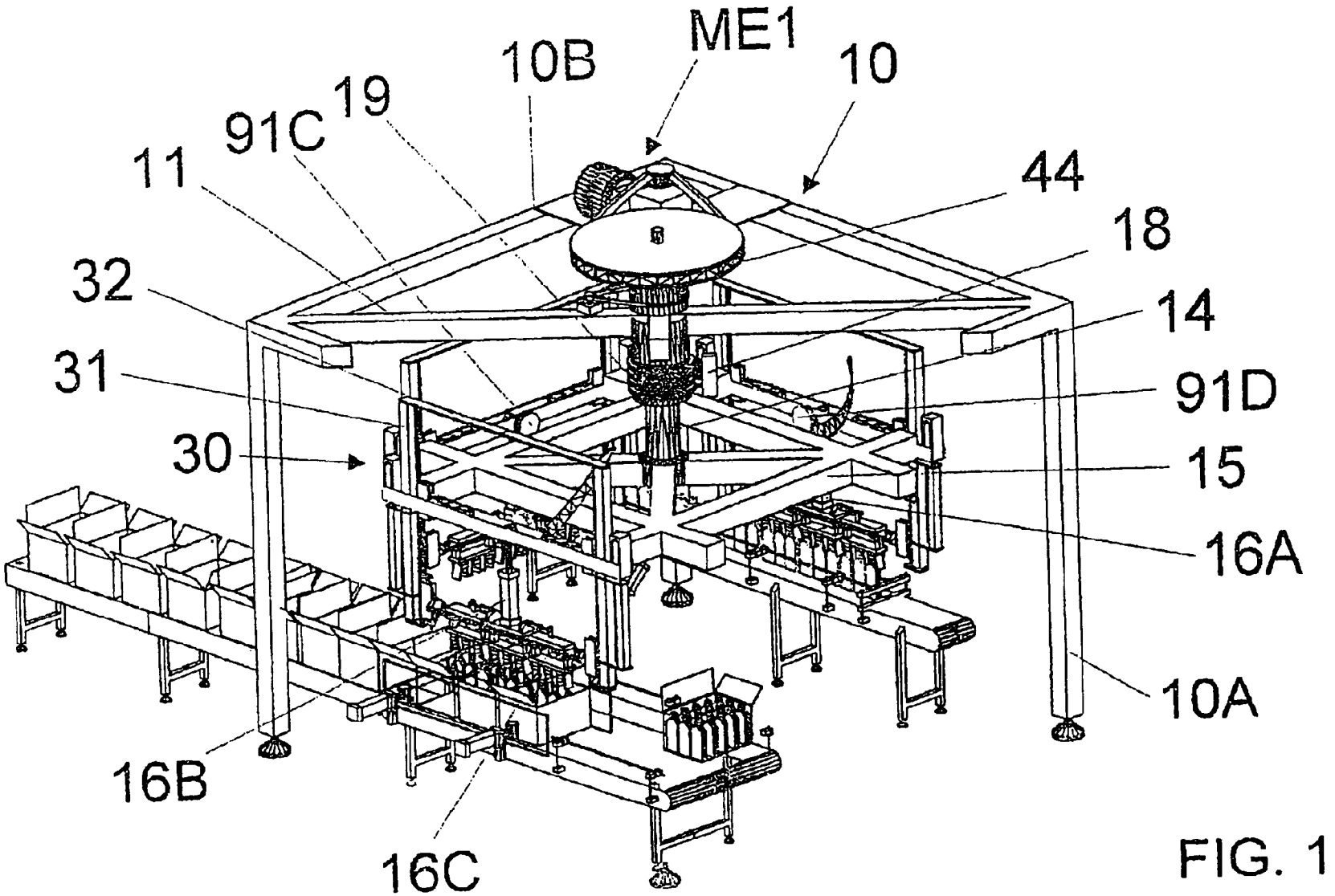
FIG. 1 is a view in axonometric projection of the cartoning machine, with partially broken away portions, operating with containers (bottles) fed on one row for their arrangement in 12-bottle cartons and showing a first embodiment for operating the cartoning heads.

With reference to FIG. 1, the rotatable cartoning machine consists of a frame 10 shaped as a parallelepiped with square base having four uprights 10A, four upper beams 10B and two diagonal crosspieces 11 at the upper side which carry a vertical main shaft 14 driven by an electrical motor ME1 to rotate stepwise in either direction. Shaft 14 rotates stepwise by predetermined angles and stops during its working cycle at the operating stations associated therewith and according to the arrangement of the grippers carried by the cartoning heads of the machine. In this embodiment there are four stations laying down bottles into the cartons by rotation of the shaft by 180 DEG from the gripping point.

Figure 3:
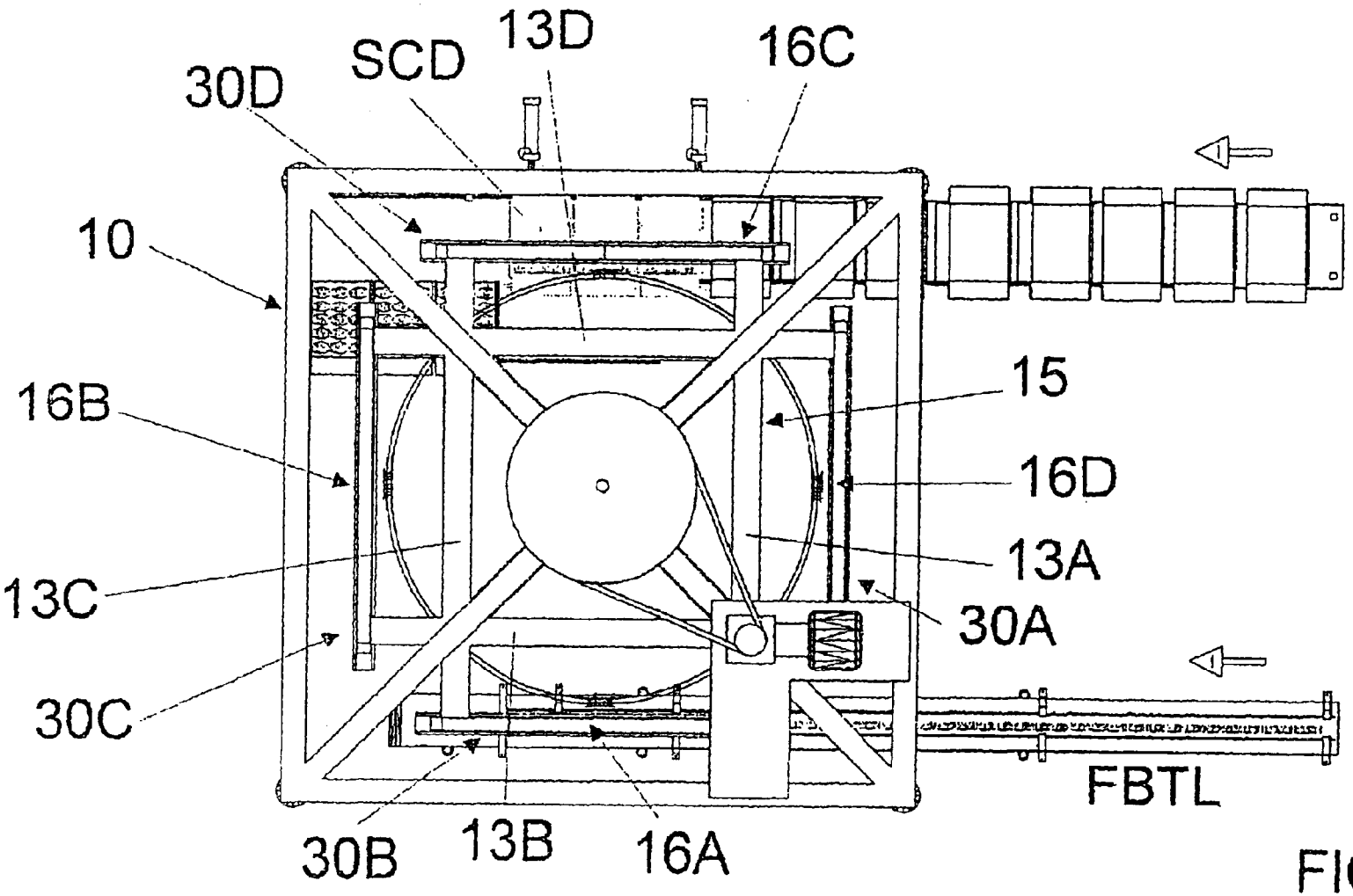
FIG. 3 is a top view of the cartoning machine of FIG. 1.

A station-holder turret 15 (FIG. 3) consisting of four rugged beams forming a square 13 A, B, C, D with extensions projecting by 90 DEG from its corners, at the four sides of which four stations or cartoning heads 16 A, B, C, D equal to one another are disposed. Therefore, the detailed description of only one of the latter will be given herebelow.

Figures 4, 6:
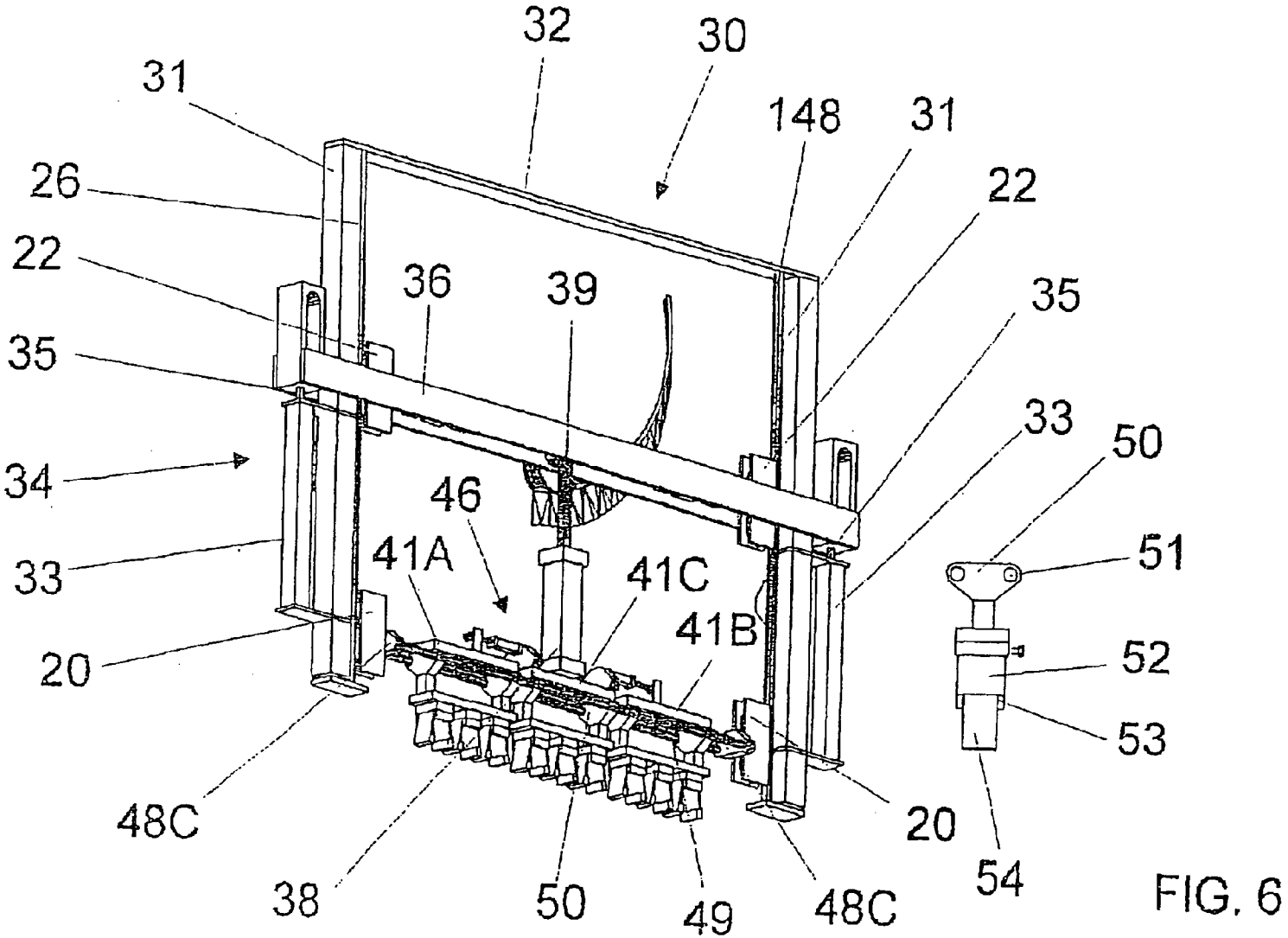
FIGS. 4 and 5 are fragmentary side elevation views showing the arrangement of the support frame of the gripper heads of the bottles to be enclosed in the packing cartons.
FIG. 6 is a detailed view showing mechanical means for adjusting the centre distance of the gripper heads.
Figure 5:
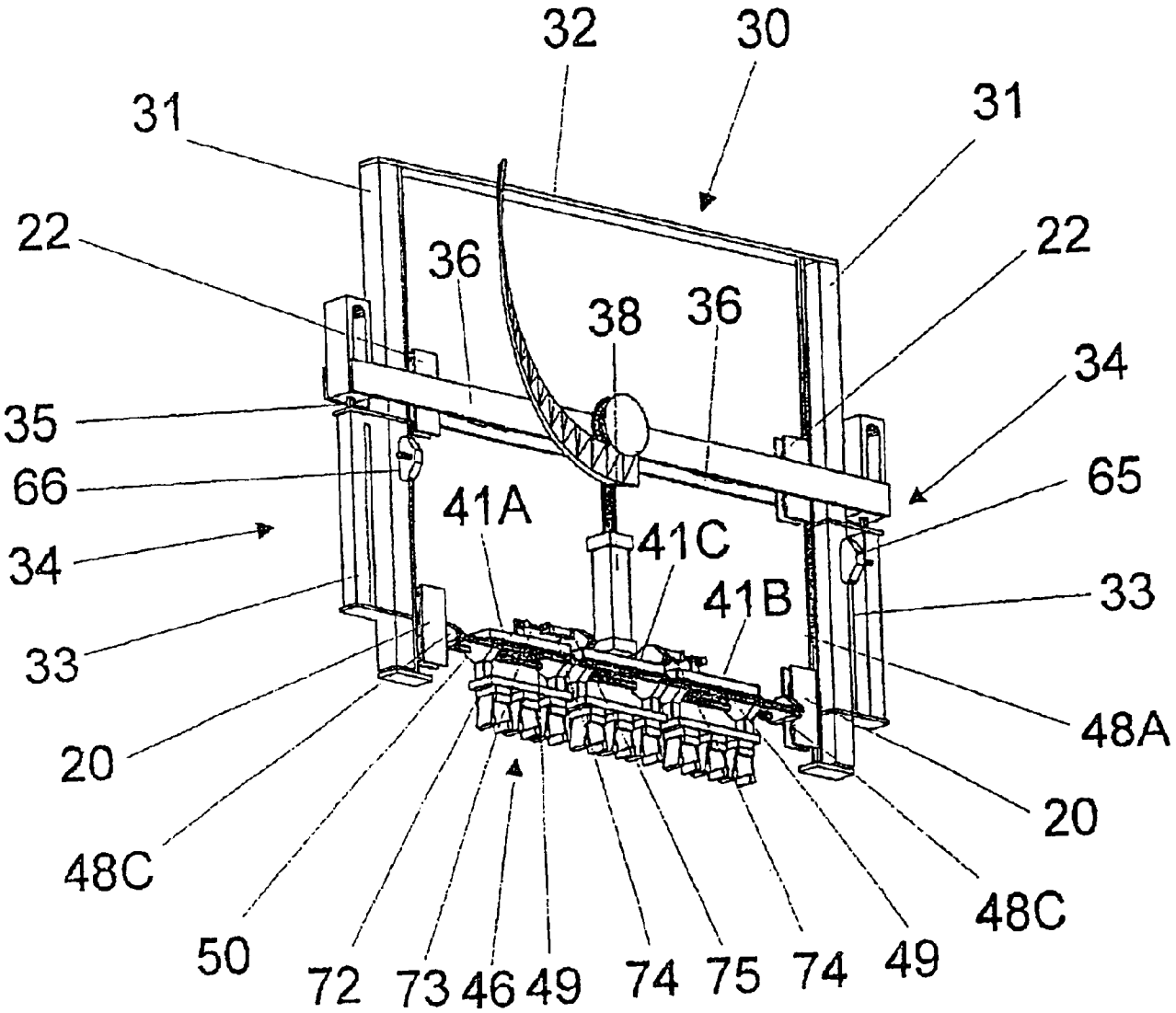

In a first embodiment each head 16 (FIGS. 2, 4 and 5) includes a frame 30 (FIG. 4) consisting essentially of two side uprights 31 connected by an upper girder 32 and encircled by a first upper beam 36 and a second lower beam 46 both movable in the vertical plane parallel to themselves. As shown in FIG. 4, body 33 of the cylinder of a pneumatic long-stroke cylinder and piston assembly is secured to each upright 31, the ends of the two parallel spaced members forming the upper beam 36 being secured to the upper end of piston 35. As shown, the two beams 36, 46 encircle both the body of the two upper carriages 22 to guide the vertical movements of the beams and the side uprights 31. In addition, a guide 148 for both upper carriages 22 and a pair of lower carriages 20 is secured to each upright 31. Secured at a central position between the parallel members 36 is the head of piston 39 of a further pneumatic cylinder and piston assembly 38 disposed vertically and supporting and moving the lower beam 46 of head 16 with respect to the upper beam 36. The lower carriages 20 (FIG. 4) carry couplings 48C to which the ends of two parallel rods 49 are connected, such rods running along the lower side of three separated portions shaped as plates 41A, 41B, 41C which form as a whole the lower beam 46. Connected to the lower surface of each plate are two supports 50 generally shaped as overturned triangles having at each upper angle (FIG. 6) an opening 51 with such a diameter as to receive the rods 49 and to allow the supports to slide smoothly thereon. Integral with the lower portion of each support. 50 (FIG. 6) is a projection 52 to which flat members 53 carrying grippers 54 at the lower side to grip the bottles are connected. The grippers 54 can be of the known type driven pneumatically between open and closed positions and will not be further described herebelow.

The assembly consisting of members 53 and grippers 54 carried under such members forms the gripper head 55 so that each station 16 has three gripper heads in the embodiment illustrated and described herein.

As shown in the illustrated embodiment, grippers 54 of the several gripper heads 55 are disposed on one row.

Figure 1A:
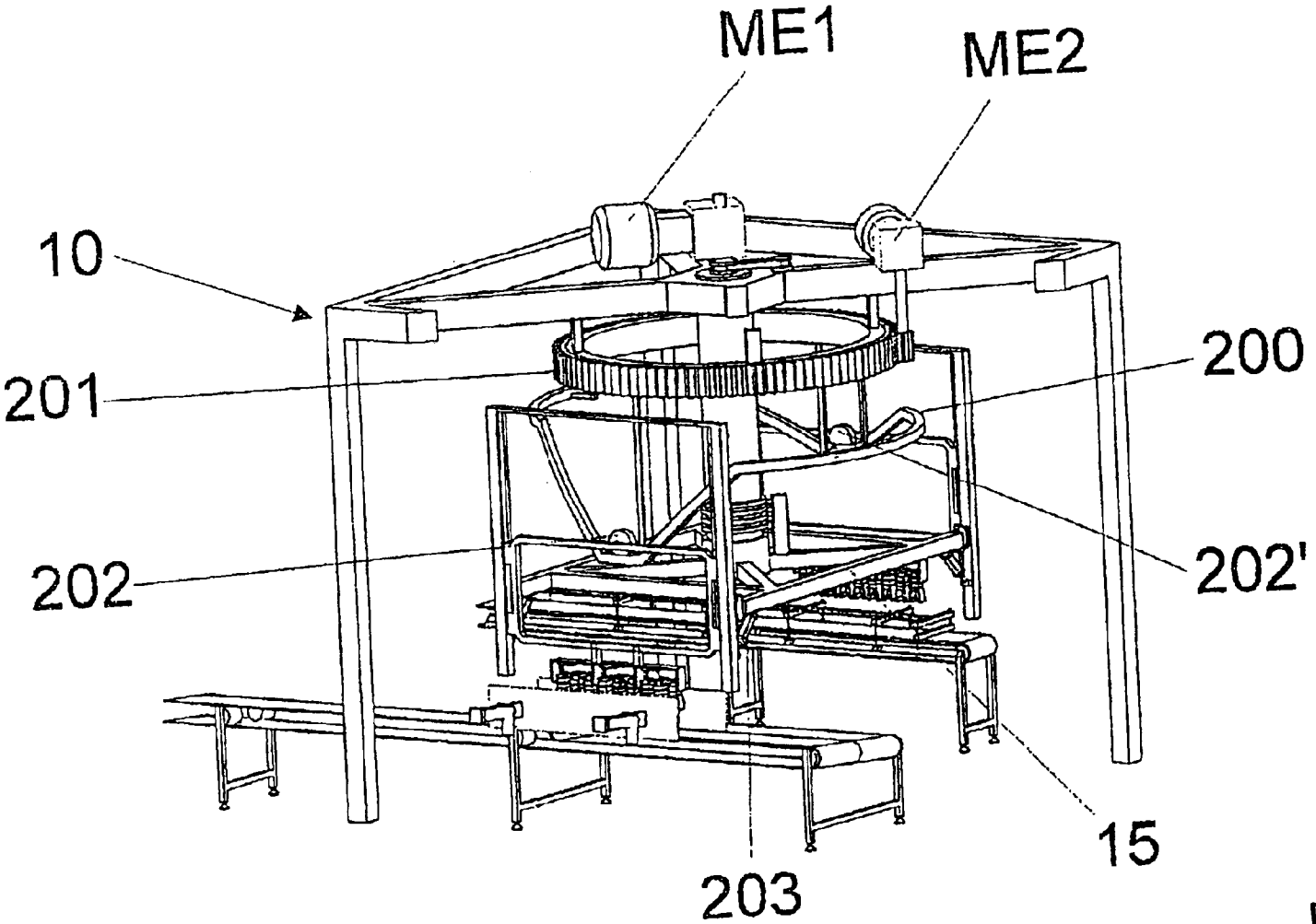
FIG. 1A is a view in axonometric projection simplified with respect to FIG. 1 and showing a second preferred embodiment for operating the cartoning heads.

FIG. 1A shows a second preferred embodiment according to the present invention of the means capable of moving in a vertical direction, shifting and rotating turret 15 and the relative cartoning heads 16. In this embodiment, turret 15 is connected by not shown uprights to guide idle pulleys 202 resting on a suitably shaped rail or cam 200 which is in turn connected to a rotating loop 201 driven by a motor ME2.

In operation, motor ME1 causes turret 15 to rotate and one of the cartoning head 16 to be disposed above the gripping station where the containers arrive from the filling machine. The grippers of the head catch the containers and then motor ME1 is driven again causing the turret to rotate, for example, by half turn; during such rotation idle pulleys 202 follow the profile of cam 200 drawing and first lifting turret 15 which is then lowered again after a rotation of 180 DEG to bring the head gripping the containers above the cartons to be filled. In this position, turret 15 along with the cartoning head carrying the containers is returned to the lower portion of the cam so that the containers can be released in the cartons to be filled.

In this embodiment, the assembly connected to frame 30 carrying the gripper heads is a simple rigid square body that can be inclined by little pistons 203 (FIG. 1A) secured to frame 10. In this embodiment, by rotating at the same time both turret 15 and cam 200, each in a suitable direction, it is possible to lower the cartoning heads 16 at each quarter of a revolution so that four cartoning heads are disposed at the same time each on one side of turret 15, all in operative condition, i.e. one head in loading position, a second head moving towards the unloading position, a third head in unloading position, and the last head moving towards the loading station.

By a suitable shaping of both cam 200 and turret 15 it is possible to have more than four cartoning heads operating at the same time.

Figure 2:
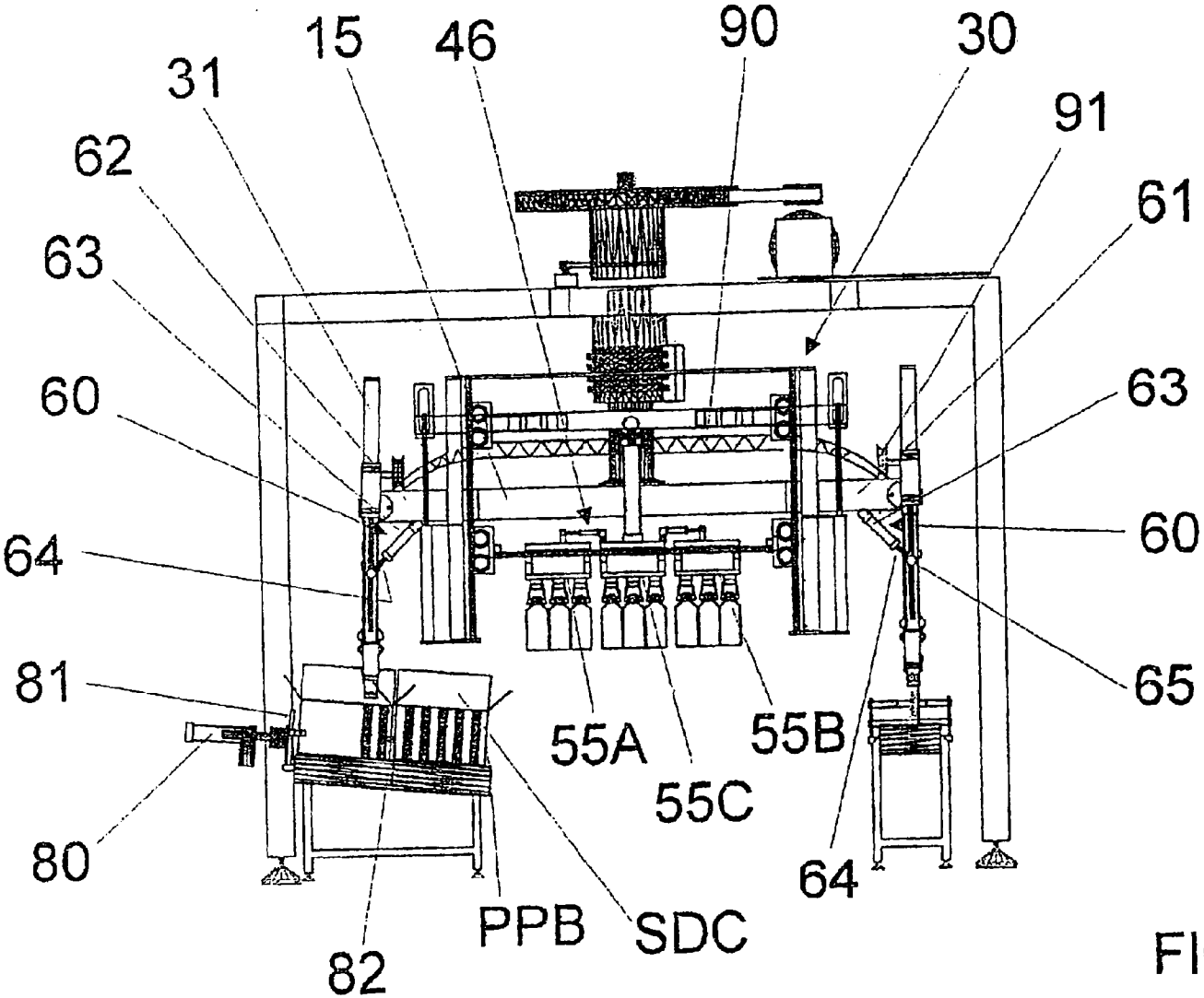
FIG. 2 is a vertical section of the cartoning machine of FIG. 1 showing the arrangement of the driving means of the cartoning heads.

FIG. 2 shows a further feature of the invention having two pneumatic cylinder and piston assemblies 60 disposed in each station between members 61 of turret 15 and the inside of uprights 31.

Cylinders 63 of pneumatic assemblies 60 are secured to the lower portion of members 61 while the annular heads of the respective pistons 64 are threaded in pins 65 integral with support 66 which is secured to the inner walls of the two uprights 31 that are hinged so as to rotate only by a small angle with respect to the vertical so that the rotation of the uprights driven by assemblies 63 causes the gripper head 55 (FIG. 2) to be inclined with respect to the horizontal plane.

As already mentioned, the lower beam 46 of each frame is formed by three separated coplanar portions 41A, 41B, 41C all slideable along rods 49 and connected to one another (FIG. 5) by two pneumatic cylinder and piston assemblies 74, the cylinder of which being secured to support 75 integral with the upper portion of member 40 and the piston 73 being secured at its end to a vertical tab 72 projecting from the upper portion of the side members 41A, 41B. It is self-evident that the two pneumatic cylinder and piston assemblies 74 have the function of varying by their stroke the distance between the side members 41A, 41B and central member 41C. Of course, the movement of the side members 41A, 41B will be followed by the side gripper heads 55A, 55B with respect to the central gripper head 55. In the operation of the machine, the pneumatic assemblies 74 have the function of separating the side gripper heads 55A, 55B from the central gripper head 55 in order to lay down the three bottles of each gripper head in three side by side cartons, with the contacting walls of them having a predetermined thickness.

In case bottles or generic containers with elongated section have to be enclosed in a carton, it is normally necessary to rotate the bottles from the incoming position at the cartoning station to another position which is more suitable to their arrangement in the cartons, and at last to settle them.

Figure 8:
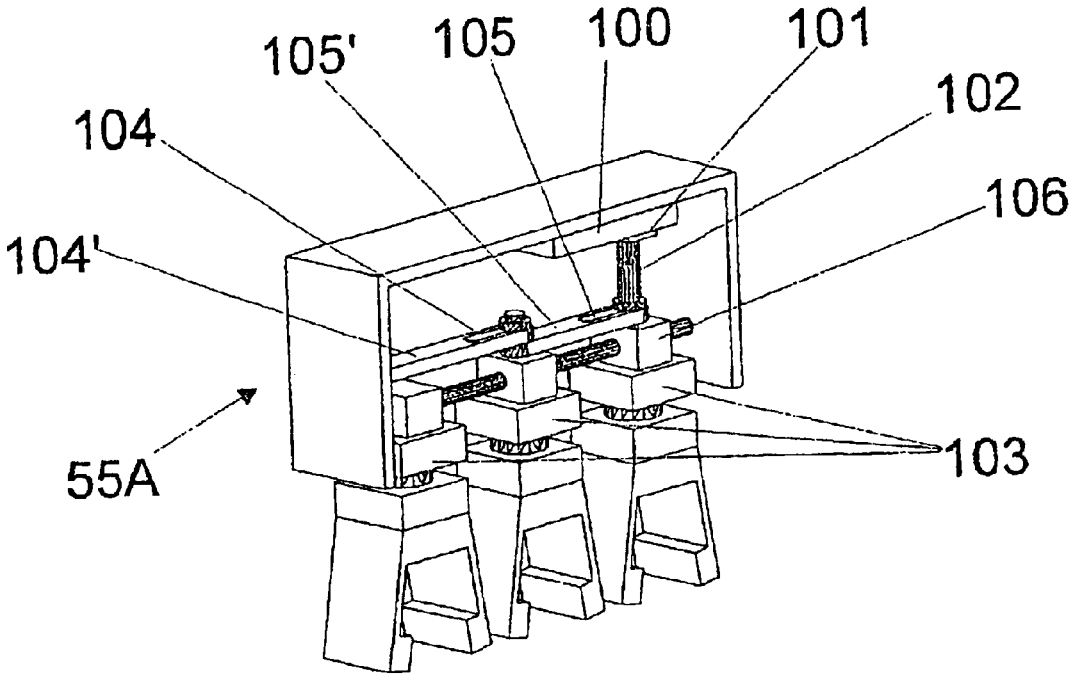
FIGS. 8 and 8A show another solution for the movement of the gripper heads of the bottles to be enclosed in the cartons.
Figure 8A:
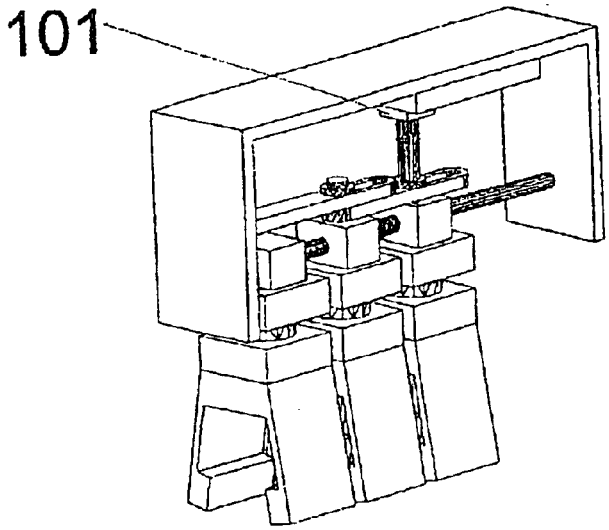

These operations are advantageously carried out by means of a mechanism shown in FIGS. 8 and 8A. Frame T carrying grippers is provided with a support 100 in which a carriage 101 slides carrying in turn one end of a rod 102 which is connected at the opposite end to a rotating cylinder 103 carrying grippers to catch a bottle BTL. Rotating cylinder 103 is pneumatically controlled to perform an axial rotation by a desired angle to bring the bottle from the position shown in FIG. 8 to a second position rotated with respect to the first position and shown in FIG. 8A.

Rod 101 passes through a slot 105' of a strap 105.

Strap 105 is connected by a rod 102' to a second strap 104 also provided with a slot 104'.

In operation, after the rotation of the three bottles from the position of FIG. 8 to the position of FIG. 8A, carriage 101 is shifted on support 100 to the left. Rod 101 crosses the whole slot 105' until its left (in the Figure) edge is reached. A further shift of rod 101 causes strap 105 and rod 102' connected thereto to further shift to the left until rod 102' has crossed slot 104' in the same way.

Now, all of the three bottles are settled to one another as shown in FIG. 8A.

A similar mechanical way of shifting can be used to modify the distance between carriages 41A, 41B, 41C (FIG. 5), if necessary.

Figure 7:
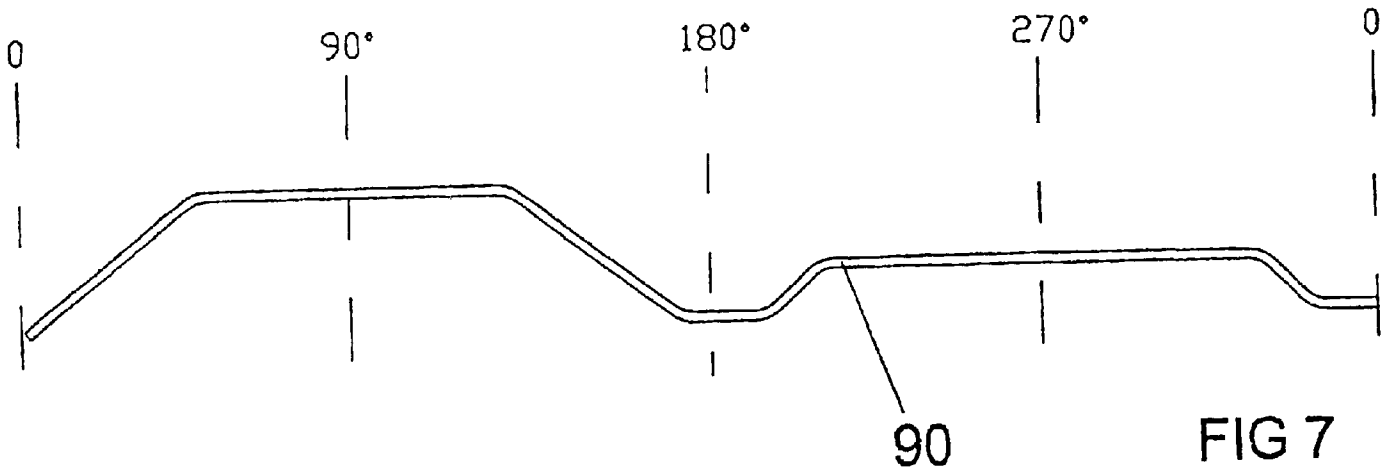
FIGS. 7 and 7A show schematically the security and setting cam in a plan view and in the vertical plane, respectively.
Figure 7A:
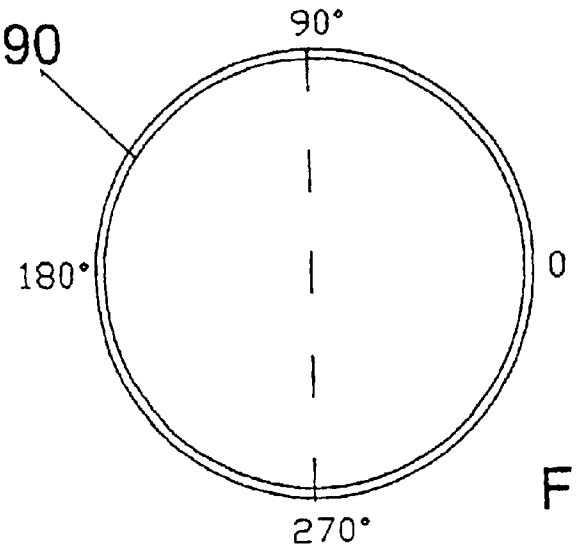

Another important feature of the machine according to the invention is the arrangement of a further pneumatic cylinder and piston assembly 80 (FIG. 2) which is disposed between upright 10A and packing carton belt conveyer 82 and the drive of which causes the cartons to shift transversally on the belt conveyer so as to allow rows of bottles to be enclosed in the cartons. Finally, in the first embodiment, secured inside frame 10 is a cam 90 having a circular shape in the projection to the horizontal plane (FIG. 7) and the shape shown in FIG. 7A in the projection to the vertical plane. Idle pulleys 91 A, B, C, D are running on the four sides of turret 15 at the four stations 16 A, B, C, D. Pulleys 91 rest on cam 90 and serve as security measure to avoid the falling down from the turret 15 in case of breakdown of the cylinder and piston assemblies 34 because of lack of compressed air. The layout of cam 90 with high and low sections reflects the vertical shift of turret 15 in its operation. The operation of the machine includes four steps: in the first step, frame 30B (FIG. 3) of station 16A is lowered to bring the gripper head 55 A, B, C into contact with the row of bottles FBTL and the operation of the latter causes nine bottles to be gripped, while at the same time frame 30D of station 16C is lowered to lay down any bottle present in the gripper head of such station into the underlying cartons SCD by operating in succession both the cylinder and piston assemblies 74 to separate the underlying gripper heads 55 A, B, C and the assemblies opening such heads. Turret 15 is then rotated by 90 DEG so that the gripper heads 55 A, B, C of station 16D take bottle BTL of the rows and lay down at the same time any bottle present in the gripper heads of station 16B into cartons SDC and so on, with the turret 15 being stopped every 90 DEG and with the alternative contemporaneous step of gripping and laying down the bottles by the pairs of stations 16 A, C and 16 B, D placed at 180 DEG from each other.

of course, the machine is provided with an encoder and a suitable software controlling both the operation of the several pneumatic cylinder and piston assemblies described above by suitable valves of the known type and the rotation angles of turret 15 by like rotation angles of shaft 14.

What is claimed is:

1. A cartoning machine for arranging conveyer-fed objects, comprising:

a base carrying a rotatable shaft;

a turret supported by said shaft;

plural working stations carried by the turret, each working station comprising gripper heads, the gripper heads configured for i) gripping objects at feeding rows, ii) moving in rotation to take the gripped objects from feeding rows of a first conveyer to a second conveyer offset from the first conveyer, and iii) releasing the moved, gripped objects into cartons carried on the second conveyer;

each of the work stations further comprising a vertical frame; and a controlled vertical mechanical means connected to each frame, each frame movable in the vertical plane under action of the controlled vertical mechanical means so that said frame can move between a lifted position and a lowered position to grip and release the objects, the vertical frame comprising a first upper horizontal supporting member movable in the horizontal plane under the action of a first controlled mechanical means, and a second lower horizontal supporting member connected to said first horizontal supporting member by a second controlled mechanical means so that the distance therebetween the first upper and second lower horizontal supporting members in the vertical plane can vary between the lifted position and lowered positions, the second lower horizontal supporting member carrying the gripper heads, each working station further comprising a controlled mechanical device located between the vertical frame and the turret, the controlled mechanical device configured for inclining the vertical frame with respect to the vertical plane by a predetermined angle to vary the inclination of gripper heads with respect to the horizontal plane.

2. Cartoning machine according to claim 1, said first and second controlled mechanical means comprising pneumatic cylinder and piston assemblies.

3. Cartoning machine according to claim 2, wherein, said first and second controlled mechanical means comprise a rail connected to said turret through idle pulleys, and said turret is rotable on the rail.

4. Cartoning machine according to claim 2, wherein there are four operating stations, and further comprising:

an helicoidal channel cam integral with said frame; and four cam follower pulleys, one cam follower pulley for each operating station, and integral with said turret, the pulleys movable along said cam acting as a support thereof in order to prevent the turret from falling.

5. Cartoning machine according to claim 5, wherein said second lower horizontal supporting member comprises a central portion and two separate side portions provided with connecting means movable to vary the distance between said two side portions from said central portion.

6. Cartoning machine according to claim 2, wherein said second controlled mechanical means comprises two pneumatic cylinder and piston assemblies.

7. Cartoning machine according to claim 5, wherein each said separate portion comprises a lower side carrying the gripper head.

8. Cartoning machine according to claim 1, wherein said controlled mechanical device comprises pneumatic cylinder and piston assemblies.

9. Cartoning machine according to claim 1, wherein, said gripper heads include each a plurality of grippers to catch said object to be cartoned, each gripper head being movable with respect to the other gripper heads of the same station by moving means, and each gripper of one gripper head being rotatable and movable with respect to the other grippers of the same head, each such movement and rotation being mechanically driven.

10. Cartoning machine according to claim 9, wherein said grippers are mechanically driven by is a pneumatically controlled means.

11. Cartoning machine according to claim 9, wherein the moving means moving the grippers of one head comprises pins slideable in slots formed in straps connected by said pins.

12. The cartoning machine of claim 1, wherein, the controlled vertical mechanical means comprises:

a moveable cam and idle pulley assembly connected to each frame and arranged to move each frame in the vertical plane between the lifted position and the lowered position, the assembly providing lifting, shifting, and rotating actions allowing the gripper heads to i) with the turret stationary, grip objects at feeding rows, ii) move in rotation to take the gripped objects from feeding rows of the first conveyer to the second conveyer offset from the first conveyer, and iii) with the turret stationary, lower and release the moved, gripped objects into cartons carried on the second conveyer.

13. The cartoning machine of claim 12, wherein the cam has a generally circular shape in horizontal projection and drives the working stations to, in parallel, grip and release the objects.

14. The cartoning machine of claim 12, wherein the cam is rotateable coaxially with and independently from the turret.

15. The cartoning machine of claim 14, wherein movements of the turret and the cam are intermittent.

* * * * *